US008210244B2

(12) United States Patent
Kuniavskyi et al.

(10) Patent No.: US 8,210,244 B2
(45) Date of Patent: Jul. 3, 2012

(54) HEAT EXCHANGER, IN PARTICULAR RADIATOR FOR MOTOR VEHICLES

(75) Inventors: Vladyslav Kuniavskyi, Stuttgart (DE); Matthias Schüle, Bietigheim-Bissingen (DE)

(73) Assignee: Behr GmbH & Co. KG, Stuttgart (DE)

( * ) Notice: Subject to any disclaimer, the term of this patent is extended or adjusted under 35 U.S.C. 154(b) by 818 days.

(21) Appl. No.: 11/577,211

(22) PCT Filed: Oct. 12, 2005

(86) PCT No.: PCT/EP2005/010978

§ 371 (c)(1), (2), (4) Date: Jun. 14, 2007

(87) PCT Pub. No.: WO2006/042680

PCT Pub. Date: Apr. 27, 2006

(65) Prior Publication Data

US 2008/0029253 A1 Feb. 7, 2008

(30) Foreign Application Priority Data

Oct. 14, 2004 (DE) ..... 10 2004 050 159

(51) Int. Cl.
*F28F 27/02* (2006.01)
*F01P 7/02* (2006.01)

(52) U.S. Cl. ..... 165/101; 165/103

(58) Field of Classification Search ..... 165/101, 165/102, 103, 174, 175, 71, 178, 147, 146; 236/12.3, 34.5, 12.13
See application file for complete search history.

(56) References Cited

U.S. PATENT DOCUMENTS

| | | | | | |
|---|---|---|---|---|---|
| 1,932,574 | A | * | 10/1933 | Church | 165/280 |
| 2,143,565 | A | * | 1/1939 | Minea | 137/600 |
| 2,469,212 | A | * | 5/1949 | Shaw | 236/34.5 |
| 3,047,274 | A | * | 7/1962 | Wilson | 165/281 |
| 3,318,333 | A | * | 5/1967 | McCollum et al. | 137/625.69 |
| 3,440,833 | A | * | 4/1969 | Fernandes | 62/196.4 |
| 3,554,440 | A | * | 1/1971 | Austin et al. | 236/34.5 |
| 4,139,054 | A | * | 2/1979 | Anderson | 165/76 |
| 4,196,847 | A | * | 4/1980 | Gobien | 236/34.5 |
| 4,537,346 | A | * | 8/1985 | Duprez | 236/34.5 |
| 5,400,752 | A | * | 3/1995 | Madeley | 123/198 DB |
| 5,915,464 | A | | 6/1999 | Kalbacher et al. | |
| 2002/0005179 | A1 | | 1/2002 | Frunzetti et al. | |

FOREIGN PATENT DOCUMENTS

| | | |
|---|---|---|
| DE | 196 26 639 C1 | 11/1997 |
| DE | 196 52 117 C1 | 4/1998 |
| DE | 196 43 902 A1 | 5/1998 |

(Continued)

*Primary Examiner* — Tho V Duong
(74) *Attorney, Agent, or Firm* — Foley & Lardner LLP

(57) ABSTRACT

The invention relates to a heat exchanger, in particular a radiator for motor vehicles, comprising a black consisting of tubes and ribs and a lower and upper collection chamber, the lower collection chamber having several chambers which are separated from one another by partitions and between which a fluidic connection can be established. If necessary, by means of a displaceable actuator via connection orifices (17, 18, 19) that are located in a connection channel (16). According to the invention, the actuator is configured as a piston (30) that can be displaced axially between an open and a closed position and the cross-sections of the connection channel (16) and the piston (30) taper from the exterior to the interior in the vicinity of the connection orifices (17, 18, 19).

7 Claims, 7 Drawing Sheets

FOREIGN PATENT DOCUMENTS

| | | | |
|---|---|---|---|
| DE | 100 19 029 | A1 | 10/2001 |
| DE | 100 41 122 | A1 | 3/2002 |
| EP | 1 439 366 | A2 | 7/2004 |
| FR | 1 524 268 | A | 5/1968 |
| GB | 1 444 429 | A | 7/1976 |

* cited by examiner

HEAT EXCHANGER, IN PARTICULAR RADIATOR FOR MOTOR VEHICLES

The invention relates to a heat exchanger, in particular a radiator for motor vehicles, such as that known from the applicant's DE A 100 41 122.

BACKGROUND

Radiators for motor vehicles serve for cooling an internal combustion engine and are connected to a coolant circuit which consists essentially of a radiator forward flow or engine return flow, of a radiator return flow or engine forward flow with coolant pump and of a bypass with a thermostatic valve. A multiplicity of secondary circuits, for example for a charge air cooler or an oil cooler, are connected to such a coolant circuit, the individual circuits having a different temperature level and therefore being separated from one another by means of separate chambers. The chambers are part of header boxes of the coolers and are divided off from one another by means of partitions. During the filling or emptying of the radiator of the coolant circuit, the individual chambers are to communicate with one another, so that a more rapid and a uniform filling without air inclusions and, likewise, a faster emptying are possible.

It was therefore proposed, in DE-A 100 41 122, to connect the individual chambers of a header box to one another by means of a duct, each chamber being fluidically connected to the duct interior via a connecting orifice. The duct of hollow-cylindrical design can have inserted in it a tubular connection piece with connecting orifices which are arranged in the same positions as the orifices in the connecting duct. By the tubular connection piece being rotated about its longitudinal axis, these orifices can, on the one hand, be brought into congruence, so that all the chambers communicate with one another, and, on the other hand, are closed by further rotation. This solution has the disadvantage that, in the closed state, the sealing off of the individual chambers with respect to one another is inadequate, because this sealing takes place only via the gap between the tubular connection piece and the duct inner wall. The selected gap must therefore be relatively small, thus resulting, in turn, in relatively high adjustment forces for adjusting this actuating member. Moreover, under certain circumstances, the use of special sealing elements of complicated configuration is required in order to obtain permanent and complete leaktightness.

SUMMARY

The object of the present invention, therefore, is to improve a heat exchanger, in particular radiator, of the type initially mentioned, in such a way that, when the actuating member is in the closed state, the chambers are sufficiently sealed off with respect to one another and can be connected to one another with a sufficient cross section.

According to the invention, there is a provision for the actuating member to be designed as a piston adjustable axially between an open and a closed position, and for the cross sections of the connecting duct and of the piston to be designed differently in the region of the connecting orifices. Thus, by axial displacement which requires only low adjustment forces, the piston can be brought into a discharge or a filling position, in which all the chambers communicate with one another via the connecting orifices in the connecting duct. The piston can likewise be brought by axial displacement into the closed position in which all the chambers are sealed off with respect to one another.

Preferably, the cross sections of the connecting duct and of the piston are designed decreasingly from a first outermost connecting orifice to a second outermost connecting orifice, the first and the second outermost connecting orifice lying opposite one another, and, if appropriate, further connecting orifices being arranged along the connecting duct between the outermost connecting orifices.

According to an advantageous refinement of the invention, the connecting duct is designed as a stepped duct and the piston as a stepped piston. Each step forms, in the region of the connecting orifices, annular gaps which, in the closed position, are sealed off with respect to one another and, in the open position, that is to say after the axial displacement of the stepped piston, communicate with one another. For example, with three connecting orifices, the piston has three steps forming three annular gaps which, after the retraction of the stepped piston, form a continuous gap. Advantageously, the sealing off of the annular gaps with respect to one another takes place by means of O-rings which are arranged on the stepped piston and which slide on the inner wall of the stepped duct during the axial movement of the stepped pistons.

According to an advantageous refinement, at least one connecting orifice is arranged in the axial direction of the piston, so that more connecting orifices can be connected than there are annular gaps. For example, four connecting orifices can then be connected to one another by means of a three-step piston.

According to a further advantageous refinement of the invention, portions of the connecting duct and of the piston are designed conically. In the closed position, the piston bears against the conical inner wall of the connecting duct and consequently closes the connecting orifices, the chambers thus being sealed off with respect to one another. In the open position, which is reached as a result of the axial retraction of the conical piston, there is between the outer face of the piston and the inner face of the connecting duct an annular gap which connects the connecting orifices fluidically to one another. The chambers can consequently communicate with one another. Advantageously, sealing rings or sealing ribs are arranged on the circumference of the piston and they improve sealing off, without thereby appreciably increasing the adjustment forces. The conicity is to be selected such that, on the one hand, good sealing off and, on the other hand, an easy release from the sealing-off or closed position are possible.

In an advantageous refinement of the invention, the piston, whether it is a stepped piston or a conical piston, has at its outer end a fastening portion which is inserted into a corresponding closing orifice in the header box. Advantageously, the fastening portion is a threaded portion on the piston and the closing orifice in the header box is a threaded bore. The piston is therefore screwed into the thread, thereby at the same time bringing about the required axial movement for reaching an open and a closed position. The rotational movement of the piston for axial adjustment may take place via a hexagon socket on the outer end face of the piston.

BRIEF DESCRIPTION OF THE DRAWINGS

Exemplary embodiments of the invention are illustrated in the drawing and are described in more detail below.

In the drawing.

DETAILED DESCRIPTION

Figure 1:
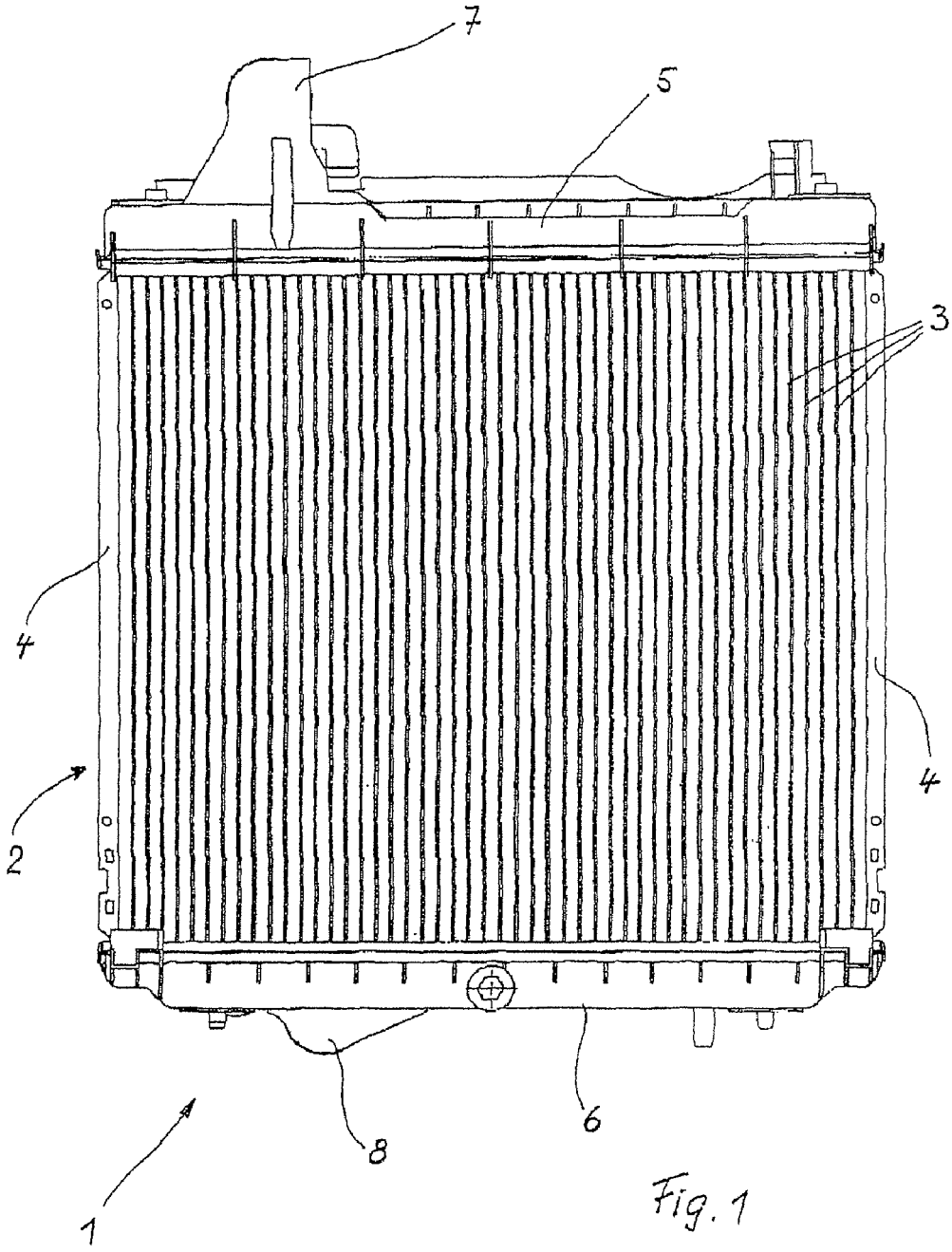
FIG. 1 shows a radiator.

FIG. 1 shows a radiator 1 with an air-cooled radiator block 2. The radiator block 2 consists of cooling tubes 3, in particular of flat tubes, between which corrugated ribs, not illustrated, are arranged. The radiator block 2 is closed off laterally by means of side parts 4. The cooling tubes 3 issue into an upper header or coolant box 5 and a lower header or coolant box 6. The inlet of the coolant takes place via an inlet connection piece 7 on the upper header box 5 and outlet takes place via an outlet connection piece 8 on the lower header box 6. The radiator 1 can be connected to a coolant circuit, not illustrated, for an internal combustion engine of a motor vehicle and is installed with vertically arranged cooling tubes 3 in the vehicle, that is to say has the coolant flowing through it from the top downward. Further secondary circuits, not illustrated here, for example for cooling a charge air cooler or an oil cooler, can be connected to this radiator 1.

Figure 2:
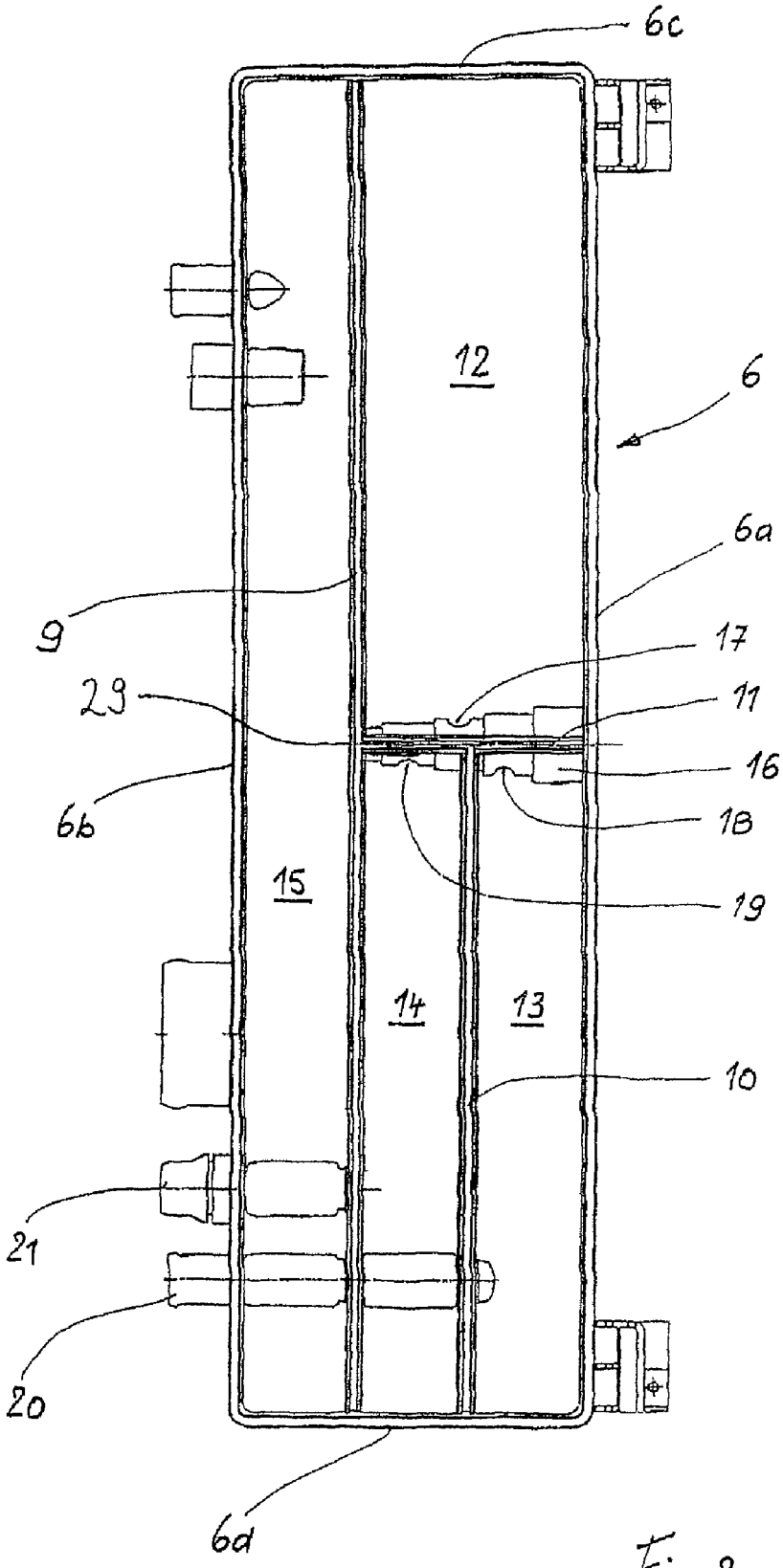
FIG. 2 shows a header box of the radiator with a plurality of chambers.

FIG. 2 shows a lower header box 6 without the radiator block 2 in a top view, that is to say in a viewing direction into the interior of the header box 6 which has a rectangular base area and is delimited by two longitudinal sides 6*a*, 6*b* and two narrow sides 6*c*, 6*d*. The entire box 6 is subdivided into four chambers 12, 13, 14, 15 by means of two longitudinal partitions 9, 10 and by means of a transverse partition 11. In the region of the transverse partition 11 is arranged a connecting duct 16 having four connecting orifices 17, 18, 19, 29 which are connected fluidically to the chambers 12, 13, 14, 15. The connecting orifice 29 is in this case arranged on the end face, that is to say in the piston axial direction, on the connecting duct. The chambers 12, 13, and 14 are connected to secondary circuits, not illustrated, via coolant connections 20 and 21.

Figure 3:
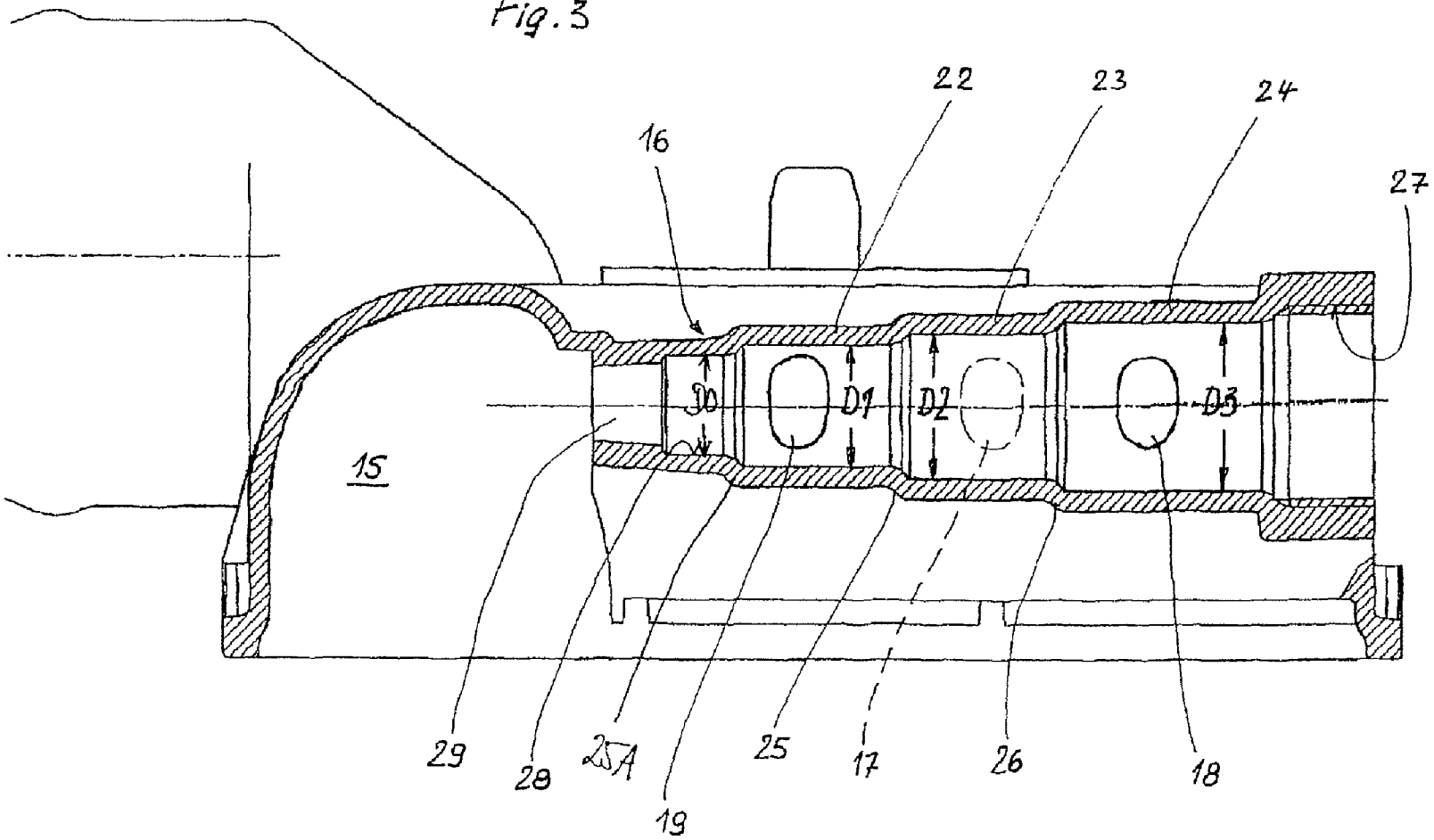
FIG. 3 shows a section through a connecting duct of step-shaped design (what is known as a stepped duct) with connecting orifices.

FIG. 3 shows a section through the connecting duct 16 in the plane of the transverse partition 11 in FIG. 2. The connecting duct 16 is of step-shaped design, that is to say it is designed as a stepped duct with different diameters D0, D1, D2, D3, where D0<D1<D2<D3. The connecting duct 16 therefore has four cylindrical portions 22, 23, 24, 28 which are connected to one another by means of steps 25A, 25, 26. The portion 24 is followed outwardly by a threaded bore 27.

Figure 4:
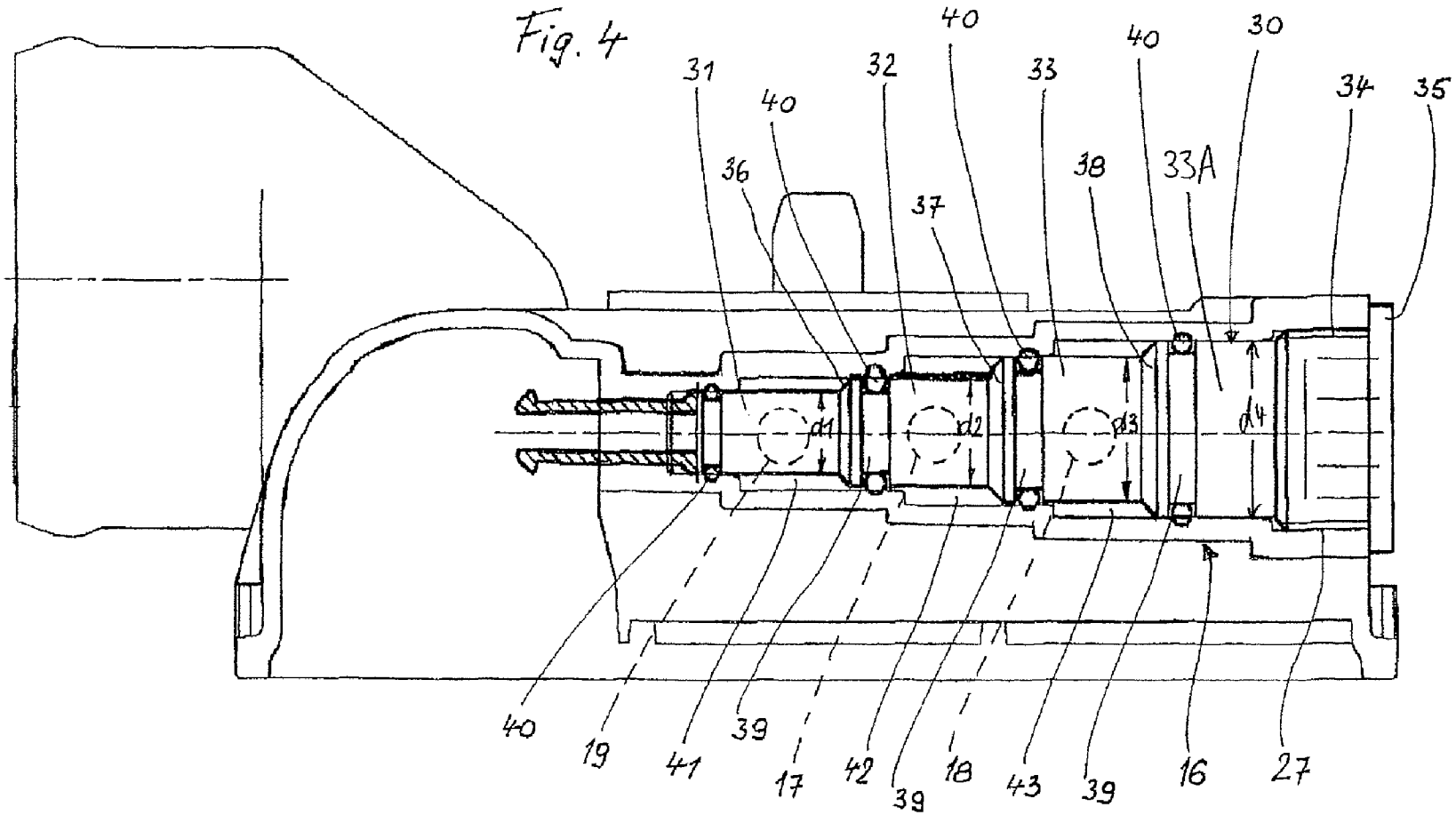
FIG. 4 shows the stepped duct with an inserted stepped piston in the closed position.

FIG. 4 shows a further stepped duct 16 with an inserted stepped piston 30 which has three cylindrical portions 31, 32, 33, 33A with increasing diameters d1, d2, d3, d4. The piston 30 has at its end a threaded portion 34 which is screwed into the threaded bore 27 of the connecting duct 16. The piston 30 has on the end face a flange 35 which serves as a stop during screwing in. The individual diameter portions 31, 32, 33, 33A are connected to one another via chamfered steps 36, 37, 38. On each diameter portion 31, 32, 33, 33A are located annular grooves 39 for the reception of sealing rings, known as O-rings 40. In the position illustrated, the piston 30 is screwed into the stepped duct up to the abutment of the flange 35 and in the region of the connecting orifices 17, 18, 19 forms with said stepped duct annular gaps 41 which, however, are sealed off with respect to one another, to the connecting orifice 29 and to the thread 34 by means of sealing rings 40. To that extent, in the valve position shown, the chambers 12, 13, 14, 15 connected via the connecting orifices 17, 18, 19, 29 and via the connecting duct 16, also called a connecting chamber, are sealed off, in particular tight to gas, to liquid and to pressure, with respect to one another and outwardly with respect to the thread 34.

Figure 5:
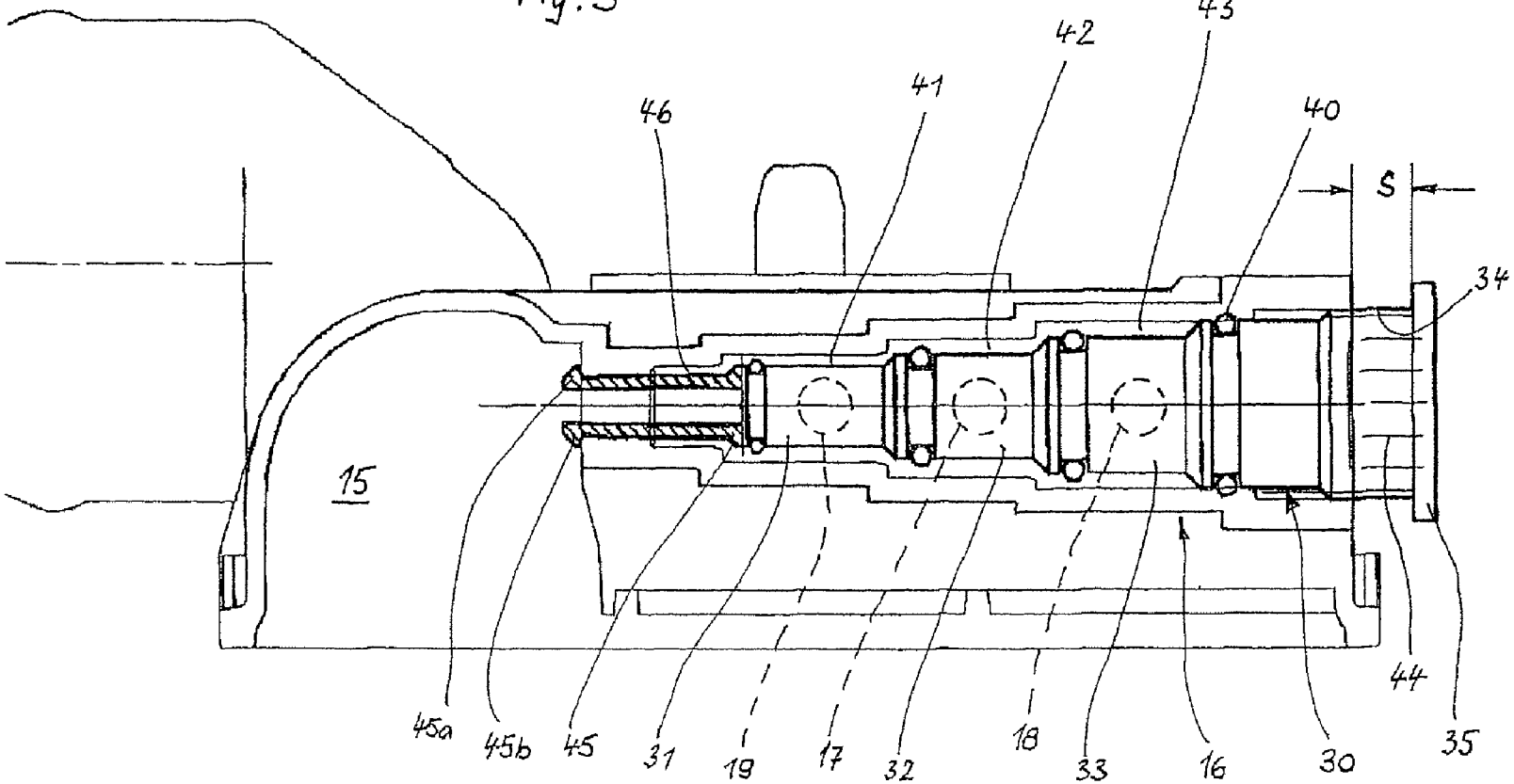
FIG. 5 shows the stepped duct with an inserted stepped piston in the open position.

FIG. 5 shows the stepped duct 16 with the stepped piston 30 in the open position, that is to say the piston 30 is displaced axially to the right by rotation as a result of the threaded portion 34, and the threaded portion 34 and the flange 35 project outward by the amount of the adjustment travel s. A profile 44, for example a hexagon socket, cross slot, outer hexagon or the like, is worked into the flange 35 or the head of the piston 30, so that the piston 30 can be rotated and consequently displaced axially by means of a wrench. Even in this extended position, the piston 30 is sealed off outwardly by means of a sealing ring 40. The inner piston portion 31 having the smallest diameter is preferably followed by an anchoring part 45 which consists of two elastically deformable legs 45*a*, 45*b* with end latching noses which form a stop during the extension of the piston. In the open position of the piston 30, as illustrated, the annular gaps 41, 42, 43 are connected to one another and thus form a continuous annular gap, into which the connecting orifices 17, 18, 19, 29 issue. To that extent, in the valve position shown, the chambers 12, 13, 14, 15 connected via the connecting orifices 17, 18, 19, 29 and via the connecting duct 16 are connected to one another and continue to be sealed off outwardly with respect to the thread 34. The corresponding chambers can consequently communicate with one another. The annular gap 41 is followed inwardly by a further annular chamber 46 via which a fluid connection to the chamber 15 of the header box 6 can be made.

The adjustment of the piston 30 to the closed position according to FIG. 4 takes place in that the threaded portion 34 of the piston 30 is screwed into the threaded hole 27. In this case, the piston 30 moves to the left in the drawing, until the O-rings 40 come into contact again with the inner wall of the stepped duct 16 and consequently bring about sealing off between the individual annular gaps 41, 42, 43 again.

Figure 6:
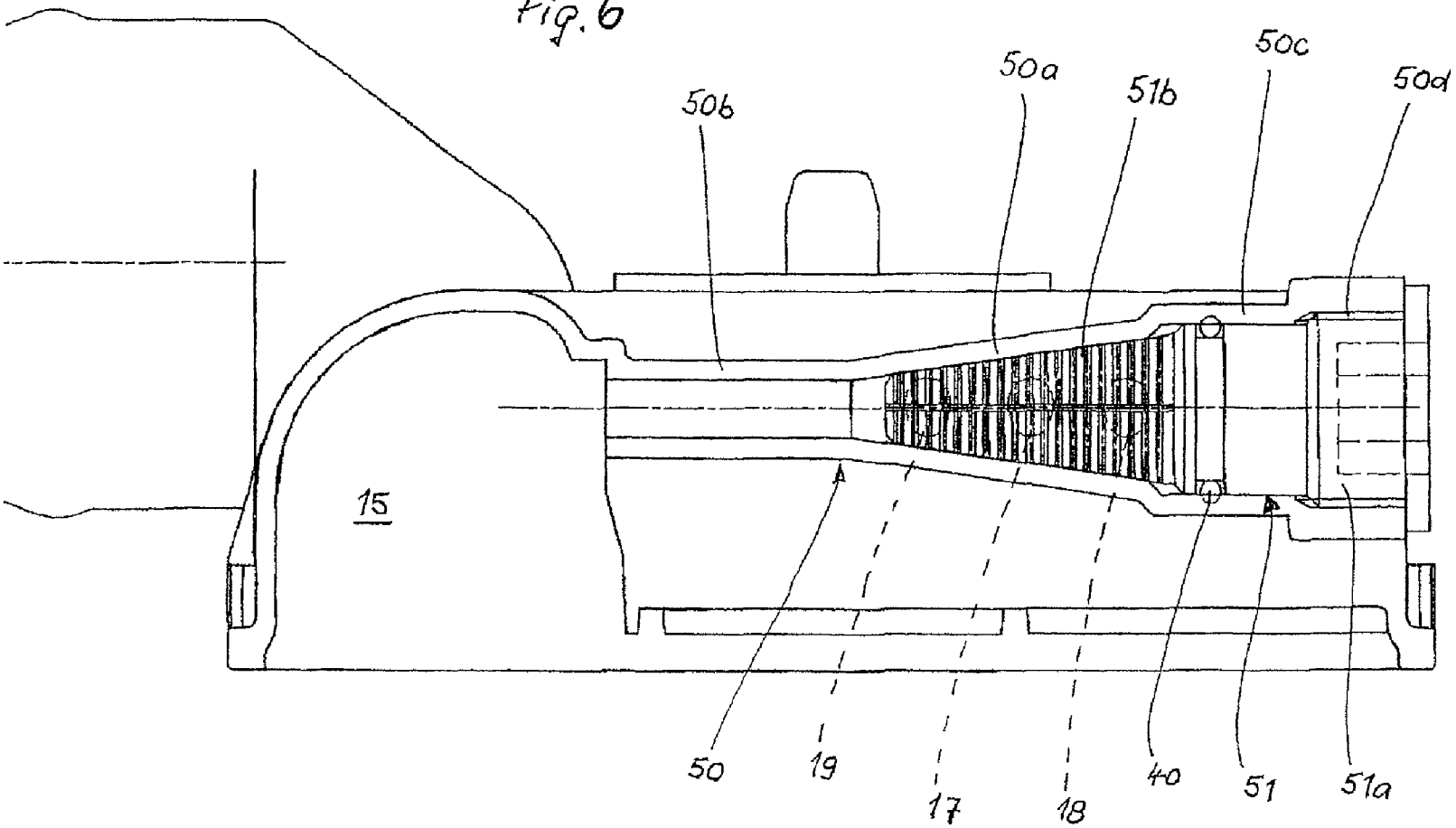
FIG. 6 shows a conically designed connecting duct with a conical piston in the closed position.

FIG. 6 shows a further exemplary embodiment of the invention, specifically in the form of a conically designed connecting duct 50 and a conically designed piston 51, the connecting orifices again being designated by 17, 18, 19, 29. The connecting duct 50 has a conical portion 50*a*, the narrowest cross section of which is followed by a cylindrical portion 50*b* which issues into the chamber 15 via the connecting orifice 29. A further cylindrical portion 50*c*, into the outer region of which an internal thread 50*d* is worked, follows on the side of the largest cross section of the conical portion 50*a*. The piston 51 has a head 51*a* which is designed in a similar way to the previous exemplary embodiment, that is to say with a threaded portion, a flange, an inner profile and a sealing ring 40 which slides on the inner wall of the cylindrical portion 50*c*. The head 51*a* of the piston is followed behind the O-ring 40 by a conical piston portion 51*b* which bears over its full circumference and over the entire length against the inner wall of the conical portion 50*a* of the connecting duct 50. The connecting orifices 17, 18, 19, 29 are consequently closed and the chambers connected to them are separated from one another.

Figure 7:
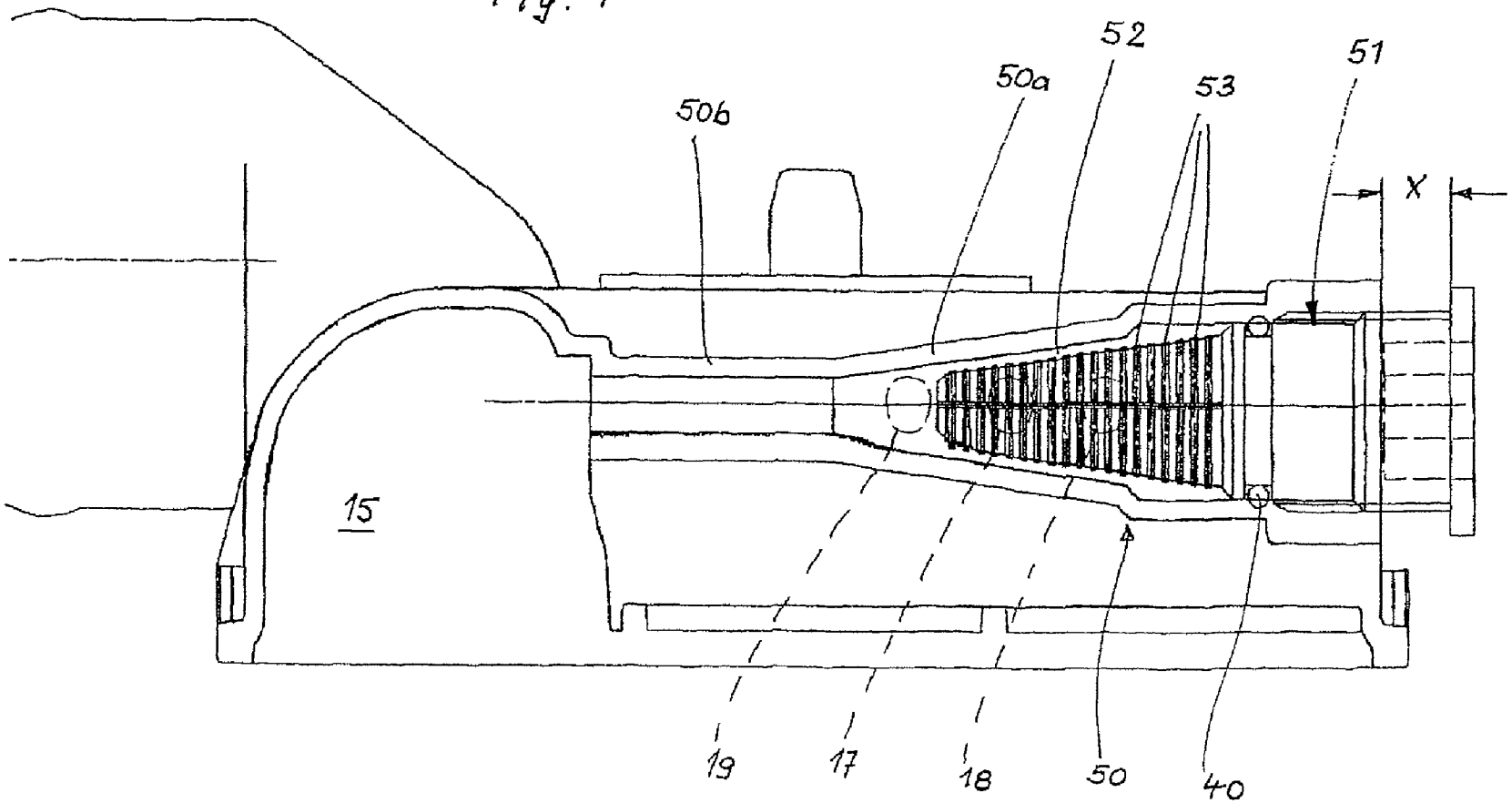
FIG. 7 shows the conically designed connecting duct with a conical piston in the open position.

FIG. 7 shows the exemplary embodiment according to FIG. 6 with the piston 51 displaced, that is to say the piston is screwed out of the connecting duct 50 by the amount of the adjustment travel x, but is still sealed off by means of the O-ring 40. Between the conical portion 50*a* and the conical part 51*b* of the piston 51, a "conical" annular gap 52 with a diameter increasing from the inside outward has arisen. As a result, the connecting orifices 17, 18, 19, 29 can communicate with one another, that is to say, likewise, the chambers assigned to them. The conical piston portion 51*b* has on its circumference a plurality of sealing rings 53 which are arranged one behind the other and which seal it off more effectively with respect to the inner wall of the conical portion 50*a* and consequently also bring about an effective sealing off of the connecting orifices 17, 18, 19, 29 with respect to one another in the closed position of the piston 51. The adjustment of the piston 51 into the closed position takes place by the piston head 51*a* being screwed into the thread 50*d* by the amount of the travel x, the piston once again being moved up to a stop. Possible tolerance overlaps are compensated by the elasticity of the sealing rings 53.

The present invention has been described by the example of a heat exchanger. It is pointed out, however, that the valve arrangement according to the invention may also be used elsewhere. In particular, the valve arrangement or the heat exchanger according to the invention is suitable both for liquid and for gaseous fluids. The heat exchanger according to the invention can be used particularly as a charge air cooler, oil cooler or heater, preferably for air, land and/or ocean vehicles.

REFERENCE NUMERALS

1 Radiator
2 Radiator block
3 Flat tubes
4 Side part
5 Upper header box
6 Lower header box
7 Inlet connection piece
8 Outlet connection piece
9 Longitudinal partition
10 Longitudinal partition
11 Transverse partition
12 Chamber
13 Chamber
14 Chamber
15 Chamber
16 Connecting duct
17 Connecting orifice
18 Connecting orifice
19 Connecting orifice
20 Coolant connection
21 Coolant connection
22 Stepped portion (D1)
23 Stepped portion (D2)
24 Stepped portion (D3)
25 Step
25A Step
26 Step
27 Threaded bore
28 Sealing portion
29 Connecting orifice
30 Stepped piston
31 Piston portion (d1)
32 Piston portion (d2)
33 Piston portion (d3)
33A Piston portion (d4)
34 Threaded portion
35 Flange
36 Step
37 Step
38 Step
39 Annular groove
40 Sealing ring
41 Annular gap
42 Annular gap
43 Annular gap
50 Connecting duct (conical)
50*a* Conical portion
50*b* Cylindrical portion, inside
50*c* Cylindrical portion, outside
50*d* Internal thread
51 Piston
51*a* Head
51*b* Conical portion
52 Annular gap (conical)
53 Sealing rings

The invention claimed is:

1. A heat exchanger for a motor vehicle, comprising:

a radiator block including a plurality of cooling tubes, at least one header box, wherein the plurality of cooling tubes are attached to the header box, wherein the at least one header box includes a plurality of chambers which are divided off from one another by partitions, a movable actuating member fluidly connecting the plurality of chambers via connecting orifices arranged in a connecting duct, wherein the actuating member is a piston adjustable axially between an open position and a closed position, and cross sections of the connecting duct and of the piston decrease in size from a first outermost connecting orifice to a second outermost connecting orifice, wherein the connecting duct is a stepped duct and the piston is a stepped piston, wherein the stepped duct has, in a region of the connecting orifices, chambers of different cross sections, and the stepped piston has piston portions of different cross sections, wherein annular gaps are provided between a wall of the stepped duct and the piston portions which, in the closed position of the piston, are sealed off with respect to one another and, in the open position, form spaces communicating with one another, wherein the annular gaps are sealed off by sealing rings arranged on the stepped piston.

2. The heat exchanger as claimed in claim 1, wherein the connecting duct has a closing orifice which is arranged on an outer surface of the connecting duct and which receives a fastening portion of the piston.

3. The heat exchanger as claimed in claim 1, wherein the connecting duct has an inflow and/or outflow orifice arranged in an interior of the header box.

4. The heat exchanger as claimed in claim 2, wherein the closing orifice is designed as a threaded bore and the fastening portion as a threaded portion.

5. The heat exchanger as claimed in claim 1, wherein the heat exchanger is configured such that the connecting orifices remain stationary while the piston is adjusted axially between the open and closed positions.

6. The heat exchanger as claimed in claim 1, wherein the heat exchanger is configured such that the connecting orifices are not fluidly connected when the piston is in the closed position.

7. The heat exchanger as claimed in claim 1, wherein the heat exchanger is configured such that when the piston is in the open position the plurality of chambers and the connecting orifices are fluidly connected by a flow path between the connecting orifices that provides a flow of fluid over an exterior of the piston.

* * * * *